US010704298B2

(12) United States Patent
Thompson et al.

(10) Patent No.: US 10,704,298 B2
(45) Date of Patent: Jul. 7, 2020

(54) PANIC EXIT DEVICE AND DOOR HANDLE

(71) Applicant: ASSA ABLOY Accessories and Door Controls Group, Inc., Monroe, NC (US)

(72) Inventors: Doug Thompson, Rockwood, PA (US); Michael Connell, Rockwood, PA (US); Luis Bettencourt, New Haven, CT (US)

(73) Assignee: ASSA ABLOY Accessories and Door Controls Group, Inc., Monroe, NC (US)

( * ) Notice: Subject to any disclaimer, the term of this patent is extended or adjusted under 35 U.S.C. 154(b) by 520 days.

(21) Appl. No.: 15/418,012

(22) Filed: Jan. 27, 2017

(65) Prior Publication Data

US 2017/0218662 A1 Aug. 3, 2017

Related U.S. Application Data

(60) Provisional application No. 62/288,779, filed on Jan. 29, 2016.

(51) Int. Cl.
*E05B 65/10* (2006.01)
*E05B 3/00* (2006.01)
(Continued)

(52) U.S. Cl.
CPC ..... *E05B 65/106* (2013.01); *E05B 1/00* (2013.01); *E05B 3/00* (2013.01); *E05B 7/00* (2013.01);
(Continued)

(58) Field of Classification Search
CPC ..... Y10T 292/0908; Y10T 292/57; Y10T 70/5159; Y10T 292/0822; Y10T 16/458;
(Continued)

(56) References Cited

U.S. PATENT DOCUMENTS 1,386,551 A * 8/1921 Bumbarger ..... E05C 3/14 292/128
3,583,740 A 6/1971 Armstrong
(Continued)

FOREIGN PATENT DOCUMENTS

DE 102010015720 10/2011
EM 000490198-0006 4/2006
(Continued)

OTHER PUBLICATIONS

THK General Catalog et al., A-523 Linear Bushing, Aug. 24, 2015, https://web.archive.org/web/20150824135803/http://www.thk.com/sites/default/files/documents/us_pdf/products/generalA/en_A_523_lbearing.pdf.

(Continued)

*Primary Examiner* — Mark A Williams
(74) *Attorney, Agent, or Firm* — Moore & Van Allen PLLC; Jeffrey R. Gray

(57) ABSTRACT

An exit device comprises an inner door handle adapted to be mounted to a door for movement relative to the door from a first position to a second position. A pair of brackets are adapted to be operatively connected between the respective ends of a horizontal portion and a vertical portion of the door handle. Each bracket comprises a first bracket member secured to the door handle, a second bracket member adapted to be secured to the door, and a pin for joining the first bracket member and the second bracket member for rotation about an axis through the pin. The first bracket member and the second bracket member pivot relative to one another when the door handle moves between the first position and the second position.

21 Claims, 20 Drawing Sheets

(51) Int. Cl.

| | |
|---|---|
| ***E05B 7/00*** | (2006.01) |
| ***E05B 1/00*** | (2006.01) |
| ***E05B 65/00*** | (2006.01) |
| ***E05C 1/12*** | (2006.01) |

(52) U.S. Cl.
CPC ..... *E05B 65/0025* (2013.01); *E05B 65/1006* (2013.01); *E05B 65/1046* (2013.01); *E05C 1/12* (2013.01)

(58) Field of Classification Search
CPC ..... Y10T 292/0972; Y10T 70/55; Y10T 292/0838; Y10T 292/0845; Y10T 292/0975; Y10T 292/106; Y10T 292/82; Y10T 70/5832; E05B 65/1006; E05B 65/0025; E05B 65/1093; E05B 65/106; E05B 65/1053; E05B 3/00; E05B 65/1066; E05B 7/00; E05B 1/00; E05B 1/0053; E05B 1/003; E05C 1/14; E04F 11/1853; Y10S 16/05; Y10S 16/41; Y10S 292/63; Y10S 292/65
See application file for complete search history.

(56) References Cited

U.S. PATENT DOCUMENTS

| | | | | |
|---|---|---|---|---|
| 3,765,198 | A * | 10/1973 | Horgan, Jr. | E05B 65/1013 292/153 |
| 4,221,563 | A | 9/1980 | Lazar et al. | |
| 4,272,923 | A | 6/1981 | Anderson et al. | |
| D267,275 | S | 12/1982 | Horgan | |
| D267,276 | S | 12/1982 | Horgan | |
| 4,366,974 | A | 1/1983 | Horgan, Jr. et al. | |
| 4,506,922 | A * | 3/1985 | Horgan, Jr. | E05B 65/106 292/336.3 |
| 4,711,480 | A * | 12/1987 | Horgan, Jr. | E05B 65/106 292/166 |
| 4,895,399 | A * | 1/1990 | Horgan, Jr. | E05B 65/1073 292/336.3 |
| 5,615,918 | A * | 4/1997 | Ferrell | E05B 1/0015 292/336.3 |
| 6,145,897 | A * | 11/2000 | Locher | E05B 65/1053 292/168 |
| 6,152,636 | A | 11/2000 | Nass et al. | |
| D444,241 | S | 6/2001 | Horgan, Jr. | |
| 6,511,104 | B1 * | 1/2003 | Horgan, Jr. | E05B 3/00 292/336.3 |
| 6,639,760 | B2 | 10/2003 | Dyer et al. | |
| 7,849,718 | B2 * | 12/2010 | Ambrass | E05B 1/0015 292/167 |
| 8,702,762 | B2 | 4/2014 | Jacene et al. | |
| 8,944,414 | B2 | 2/2015 | Sprague | |
| 2010/0199569 | A1 | 8/2010 | Piedade | |
| 2012/0167476 | A1 | 7/2012 | Weinerman et al. | |
| 2013/0305490 | A1 | 11/2013 | Sprague | |

FOREIGN PATENT DOCUMENTS

| | | |
|---|---|---|
| EM | 000490198-0009 | 4/2006 |
| EM | 000490198-0013 | 4/2006 |
| EP | 1269888 A1 | 1/2003 |
| EP | 2284338 A2 | 2/2011 |
| KR | 20020034405 A | 5/2002 |

OTHER PUBLICATIONS

Rockwood Manufacturing Company, International Patent Application No. PCT/US2017/015338, International Search Report and Written Opinion, dated Apr. 18, 2017.
C.R. Laurence Company, CRL Access Control Handles for 'All-Glass' Doors.
C.R. Laurence Architectural Products, Door Manual, All Glass Door with CRL Panic Handle, PA100F Series, 2003.
doorware.com, Alarm Rim Device, DETEX V40EB62836.
PRL Glass Panic Handles, Door Manual, PL100 Panic Handle, PL100-A Series.
PRL Glass Systems, PL-100 Panic Handle Configurations.
starhardwaresupply.com, Jackson Model 3185 Mid-Panel Concealed Vertical Rod Exit Device with Top Latch "Push", Engraved on Push Pad Aluminum Finish Left Hand Reverse Bevel Discount.

* cited by examiner

PANIC EXIT DEVICE AND DOOR HANDLE

CROSS-REFERENCE

This application is related to U.S. provisional application No. 62/288,779, filed Jan. 29, 2016, entitled "PANIC EXIT DEVICE AND DOOR HANDLE", naming Michael Connell, Doug Thompson, and Luis Bettencourt as the inventors. The contents of the provisional application are incorporated herein by reference in their entirety, and the benefit of the filing date of the provisional application is hereby claimed for all purposes that are legally served by such claim for the benefit of the filing date.

BACKGROUND

A door handle system for releasing a door latch is described and, more particularly, a door handle system is described for use as a panic exit device mounted on, for example, a glass door panel.

A panic-type exit device allows persons within the interior of a building to readily open a door in a latched position by simply pushing on an interior handle for unlatching the door. The interior handle of the panic exit device typically comprises a bar mounted to the door.

The bar is mechanically linked to a latch mechanism having an internal latch mechanism, including a door latch which is movably mounted adjacent to a free edge of the door. The handle is movable in a pivoting motion from a position away from the door to a position close to the door to actuate the latch mechanism of the door when pressure is applied towards the door at any point along the surface of the handle. Depressing the bar toward the door translates the mechanical linkage for actuating the latch mechanism in order to retract the door latch so that the door can be opened. A primary benefit of panic exit devices is that they provide unlatching of the door in a quick and simple manner. For this reason, panic exit devices are often utilized in applications which require ready exit from a building in case of an emergency.

In some panic exit devices, a fixed exterior handle is included to provide a symmetrical appearance. In addition, the door latch, or a lock mechanism, may be actuated from the exterior side of the door by use of a key, key pad, or other controlled lock release means. The lock mechanism may be a mechanical lock, a magnetic lock or an electro-mechanical lock, such as a lock operable by a solenoid.

A door handle system for releasing a door latch is needed for use as a panic exit device on a glass door panel. The new door handle system should provide for actuation of the latch mechanism in order to retract the door latch so that the door can be opened under emergency conditions.

SUMMARY

An exit device is provided for use with a door pivotally mounted along one edge for movement about an axis. The exit device comprises an inner door handle adapted to be mounted to the door for movement relative to the door from a first position to a second position. The inner door handle includes a horizontal portion and a vertical portion when mounted to the door. A pair of brackets is adapted to be operatively connected between the respective ends of the horizontal portion and the vertical portion of the door handle and the door. Each bracket comprises a first bracket member secured to the door handle, a second bracket member adapted to be secured to the door, and a pin for joining the first bracket member and the second bracket member for rotation about an axis through the pin. The first bracket member and the second bracket member pivot relative to one another when the door handle moves between the first position and the second position.

BRIEF DESCRIPTION OF THE DRAWINGS

For a more complete understanding of the panic exit device and door handle, reference should now be had to the embodiments shown in the accompanying drawings and described below. In the drawings.

DESCRIPTION

Figure 1:
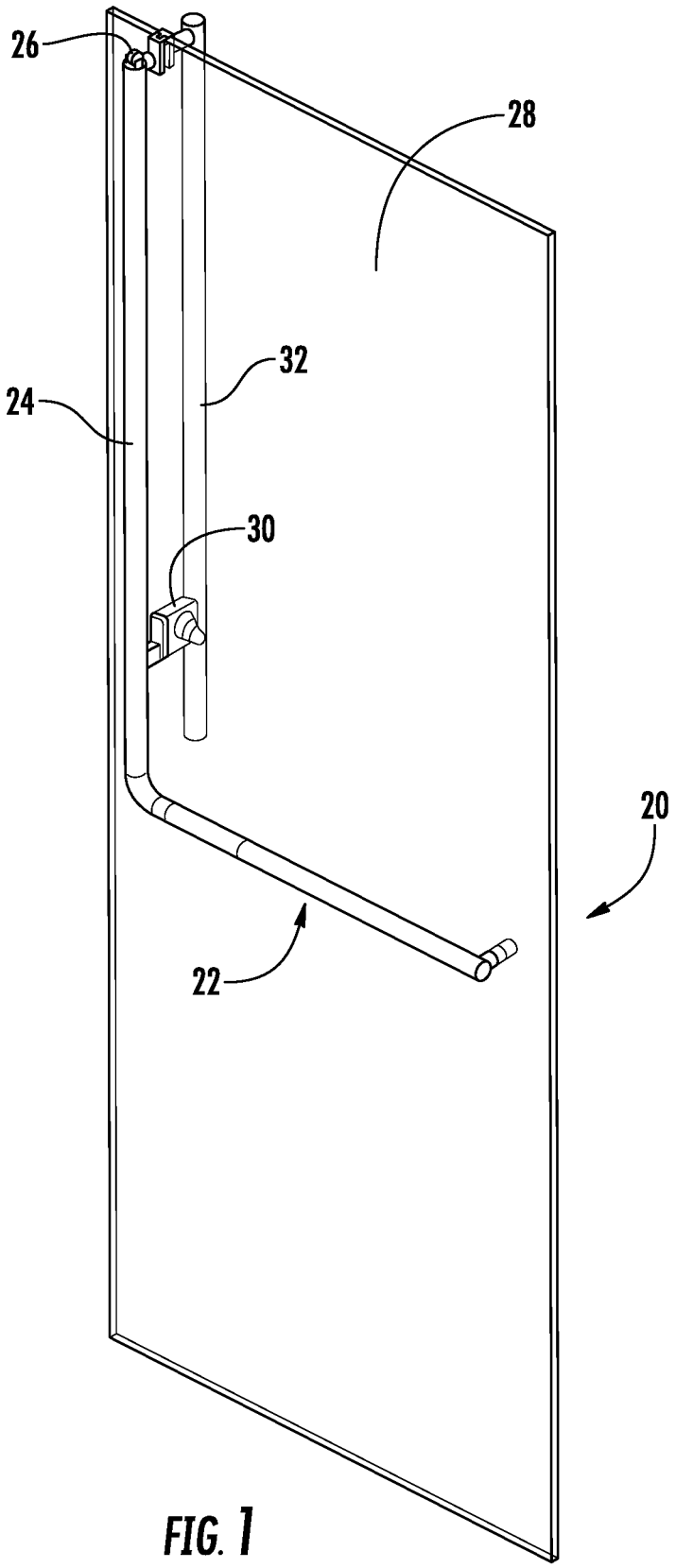
FIG. 1 is an interior perspective view of an embodiment of a panic exit device including a door handle mounted on a glass door.
Figure 2:
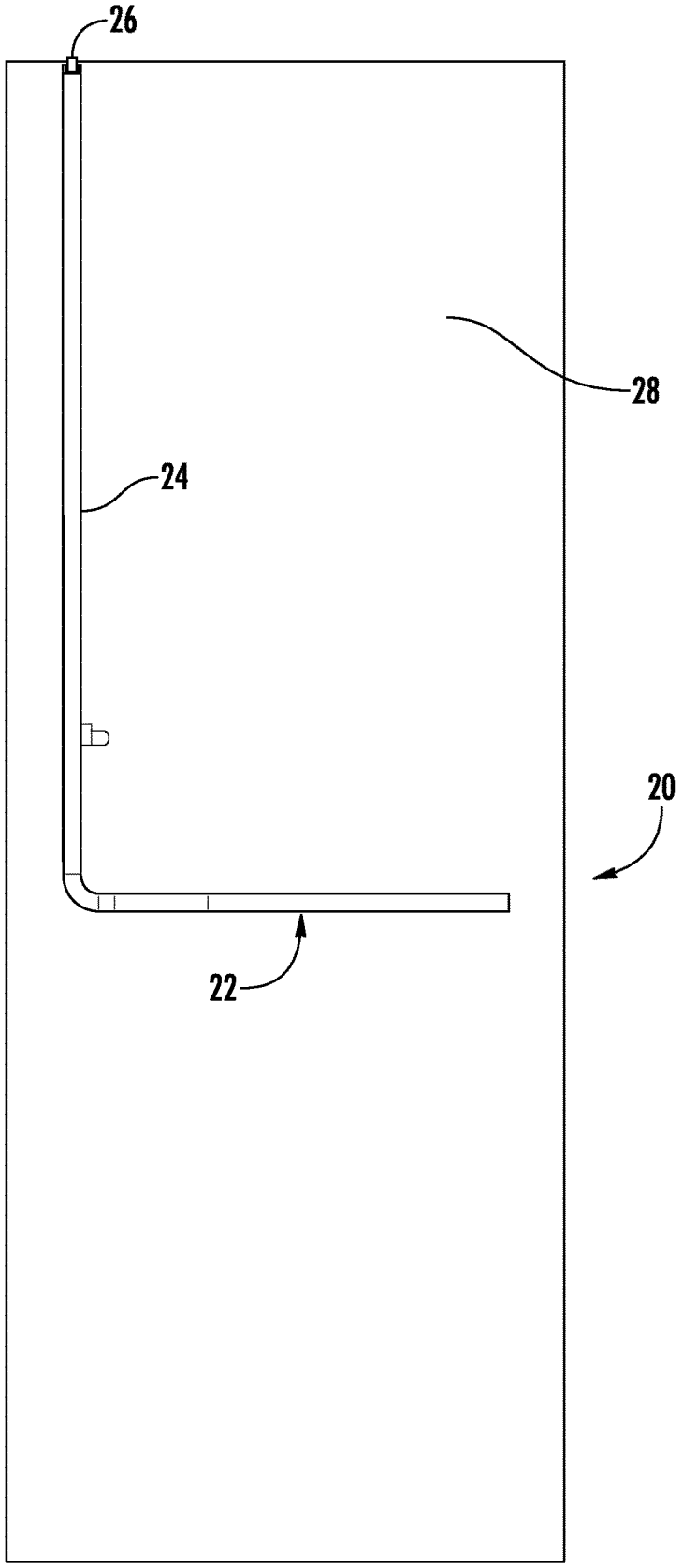
FIG. 2 is an interior elevation view of the panic exit device and door handle mounted on a glass door as shown in FIG. 1.
Figure 3:
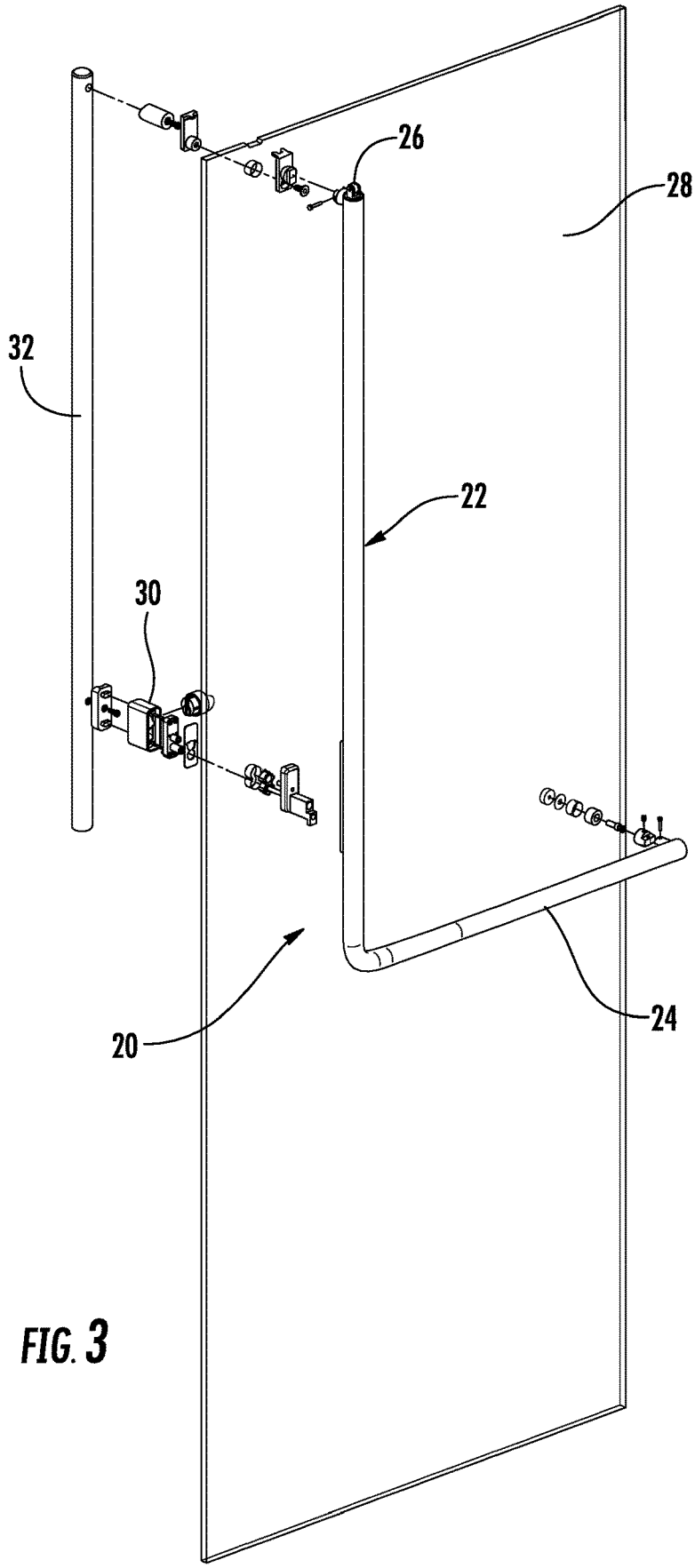
FIG. 3 is an interior exploded perspective view of the panic exit device and door handle mounted on a glass door as shown in FIG. 1.
Figure 4:
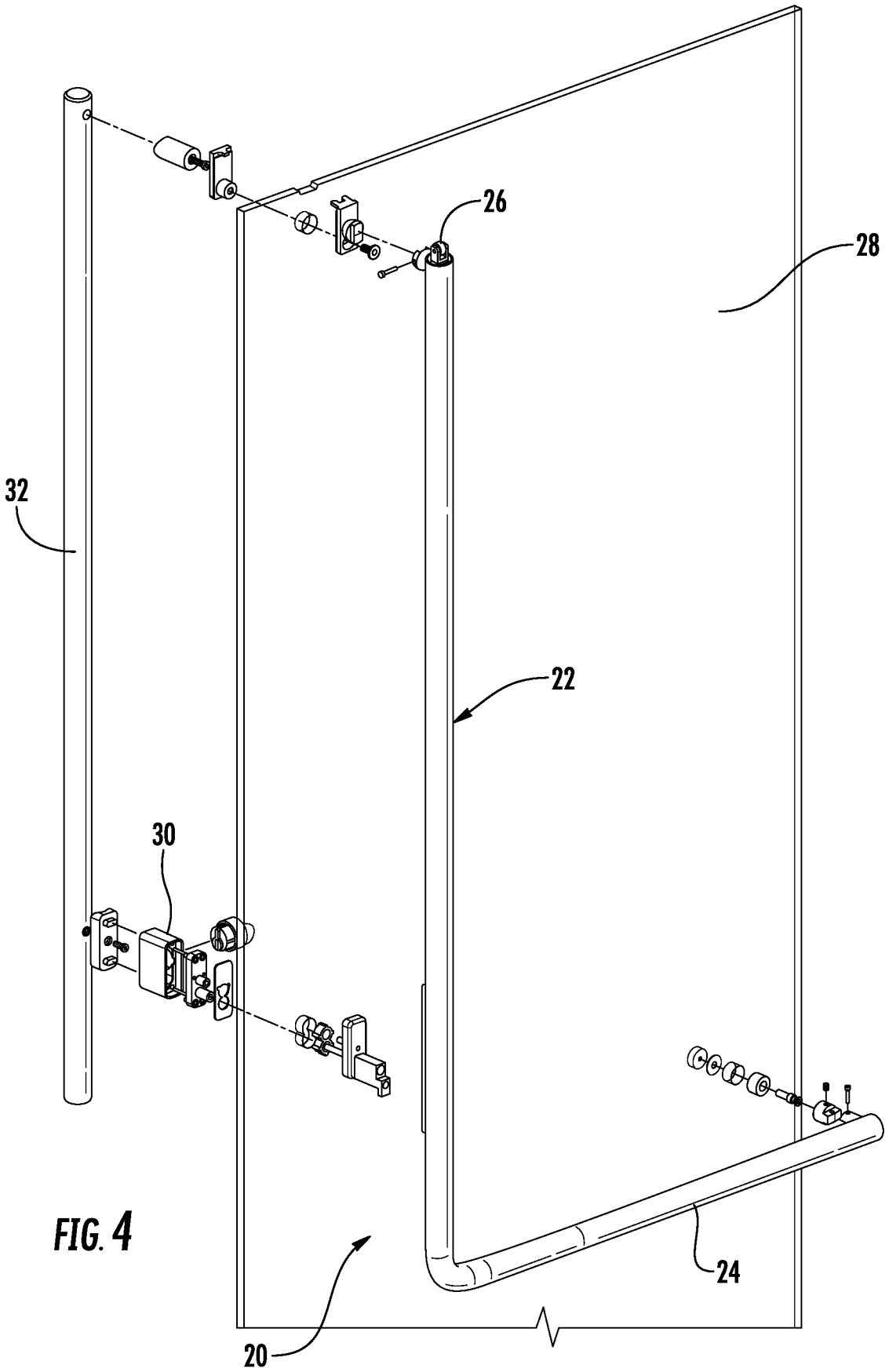
FIG. 4 is a partial interior exploded perspective view of the panic exit device and door handle mounted on a glass door as shown in FIG. 3.
Figure 5:
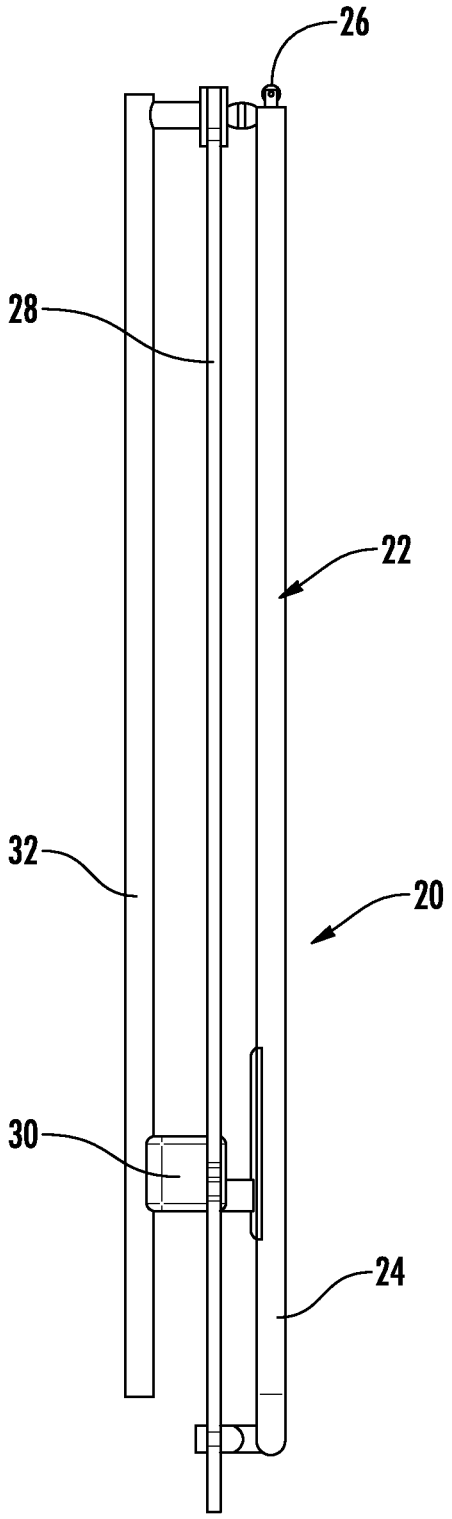
FIG. 5 is a partial side elevation view of the panic exit device and door handle mounted on a glass door as shown in FIG. 1.

A panic exit device and handle for a glass door that is described for actuating a latch mechanism. The panic exit device and handle is for use in a commercial exit device and may be used with any conventional glass door. Panic exit devices and handles for glass doors are shown in U.S. Pat. Nos. 4,366,974; 6,511,104 and 6,726,257, the contents of all of which are hereby incorporated by reference in their entirety. Accordingly, detailed explanations of the functioning of all of the exit device components are deemed unnecessary for understanding the present panic exit device by one of ordinary skill in the art.

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

Referring now to the drawings, wherein like reference numerals designate corresponding or similar elements throughout the several views, an embodiment of an exit device mounted to a glass door is shown in FIGS. 1-5 and generally designated at 20. The exit device 20 comprises a handle assembly 22, including an interior door handle 24, a latch mechanism including a roller latch 26, means for attaching the interior door handle 24 to the door 28, a lock mechanism 30, and, optionally, an exterior door handle 32 fixed to the door 28. The door 28 comprises a conventional rectangular glass door. It is understood that the exit device 20 as described herein can be used on a variety of door types, and the composition of the door may comprise any of a number of various materials, such as wood, metal, and the like. It is understood that the scope of the panic exit device 20 and door handle is not intended to be limited by the materials listed here, but may be carried out using any material which allows the construction and operation of the panic exit device described herein.

The interior handle 24 comprises an L-shaped bar including, when mounted to the door 28, a linear horizontal component and a linear generally vertical component extending either upwardly or downwardly from an end of the horizontal component. The lengths of the horizontal component and the vertical component may vary. The interior handle 24 can be of other configurations as well, such as completely straight or U-shaped. The interior handle 24 may be adapted to be mounted to a door in a variety of different orientations, such as having any number of vertical or horizontal components, as well as having any number of components of various relative angular positions.

The interior door handle 24 internally accommodates the latch mechanism with the roller latch 26 extending from an upper end of the vertical component of the door handle. As shown in the FIGS. 1-5, the interior door handle 24 is mounted at each of its ends to the inner surface of the door 28. The mounted door handle 24 is configured for limited reciprocal movement toward and away from the door 28 as the fixed ends of the handle 24 pivot relative to the door 28. Movement of the door handle 24 relative to the door facilitate translation of the roller latch 26 between extended and retracted positions for latching and unlatching, respectively, the latch mechanism. In one embodiment, a force applied to the interior handle 24 in the direction toward the door 28 actuates the latch mechanism which automatically retracts the roller latch 26 allowing the door 28 to open. It is understood that this force may be applied almost anywhere along the surface of the handle 24. The latch mechanism includes internal biasing means for moving the handle 24 away from the door 28 and returning the roller latch 26 to the extended latched position when external inward force is removed.

The exterior handle 32 is mounted to the outer surface of the door 28. The exterior handle 32 is optional and may be used without affect upon the operation of the panic exit device 20. When used, the exterior handle 32 is affixed to the door 28 in a stationary, non-movable position.

Figure 6:
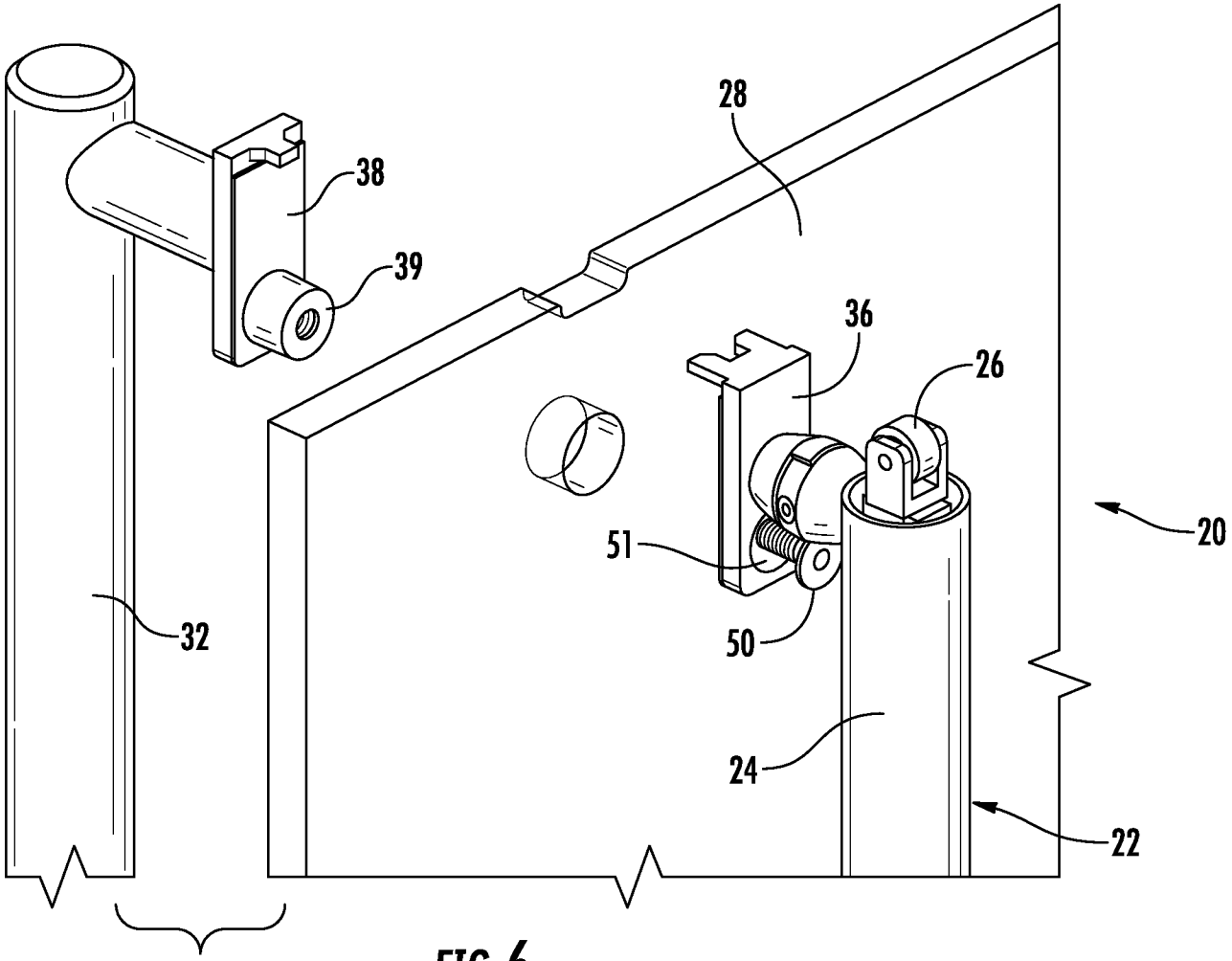
FIG. 6 is a partial interior exploded perspective view showing an embodiment of a top bracket for use with the panic exit device and door handle as shown in FIG. 1.
Figure 7:
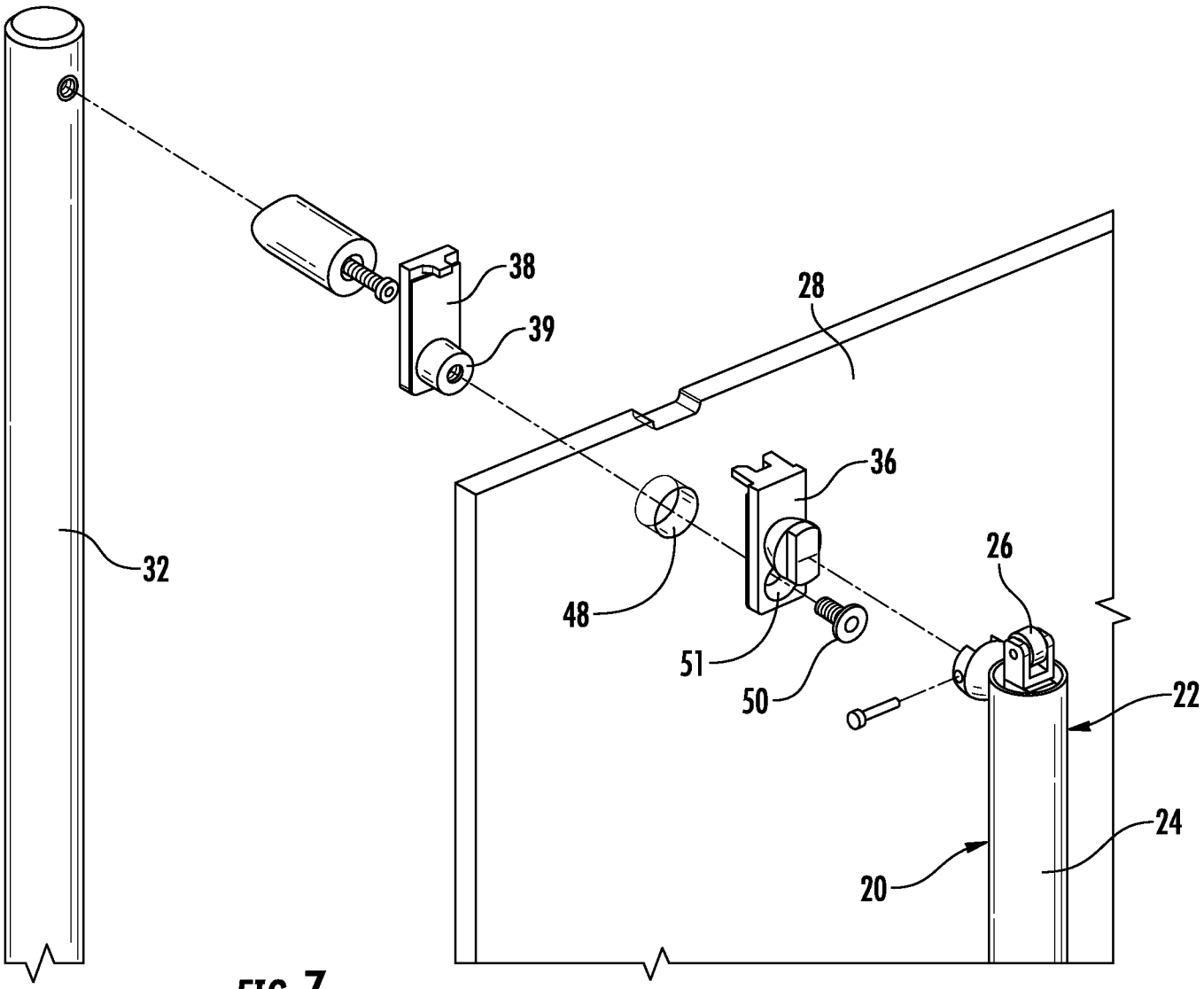
FIG. 7 is a further exploded perspective view of the top bracket and the exit device and door handle as shown in FIG. 6.
Figure 8A:
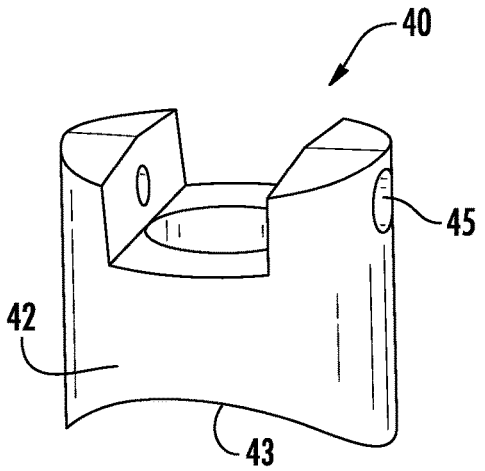
FIGS. 8A-8E are perspective and elevation views of a two-piece pivoting member for use with the bracket as shown in FIG. 6.
Figure 8B:
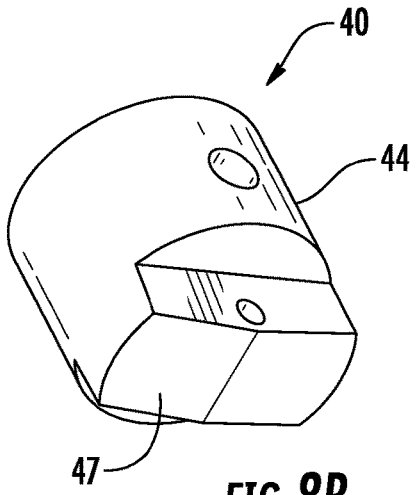
Figure 8C:
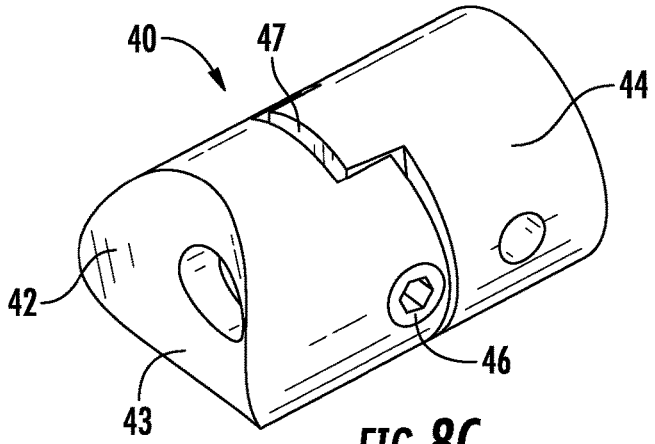
Figure 8D:
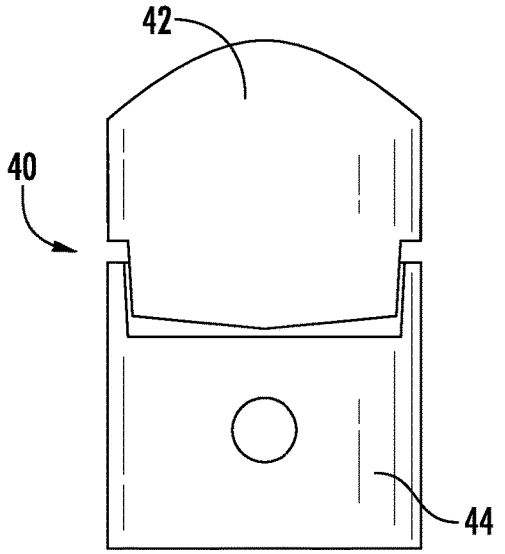
Figure 8E:
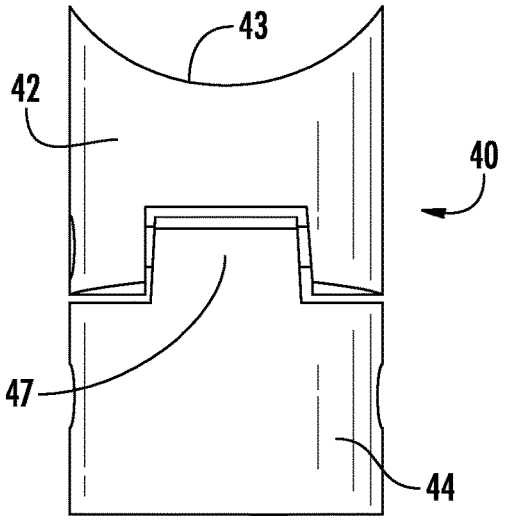
Figure 9:
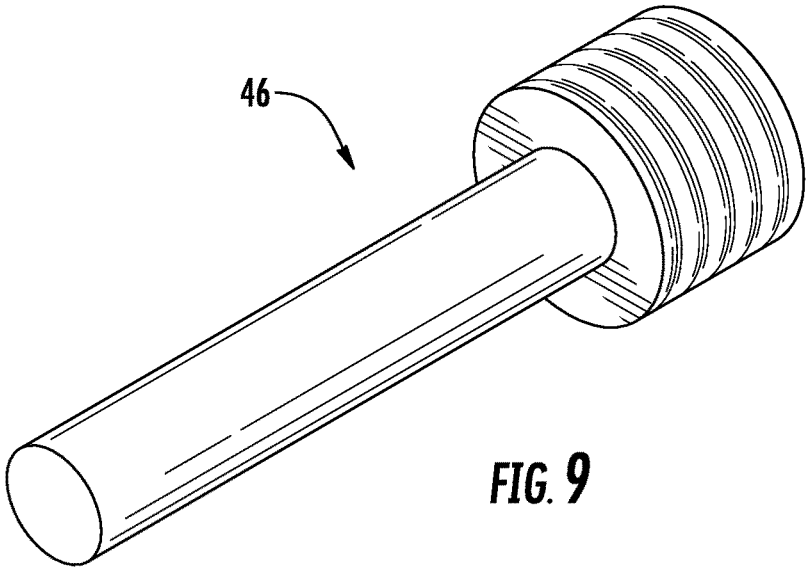
FIG. 9 is a perspective view of a pin for use with the bracket as shown in FIG. 6.

Referring now to FIGS. 6 and 7, mounting hardware 35 is shown for pivotally securing the top of the vertical component of the interior door handle 24 to the door 28. The mounting hardware comprises an interior clip 36 and an exterior clip 38 having an inwardly projecting cylindrical bushing 39, and an arcing two-piece pivot bracket generally designated at 40. The pivot bracket 40 for use in this application of the panic exit device 20 is shown in FIGS. 8A-8E. The pivot bracket 40 comprises an inner portion 42 rigidly secured to the upper end of the interior handle 24 and an outer portion 44 rigidly secured to the interior clip 36. The proximal end of the inner portion 42 defines a concave depression 43 for receiving the interior door handle 24. The distal end of the inner portion 42 is bifurcated for defining a slot. An internally threaded transverse bore 45 extends through each of the legs defining the slot. The inner end of the outer portion 44 of the pivot bracket 40 includes an inwardly projecting rectangular boss 47. The boss 47 has an opening 49 therethrough to receive a pin 46 (FIG. 9) passing through the legs of the bifurcated outer end of the interior piece 42. In this manner, the interior piece 42 and the exterior piece 44 are connected for relative pivotal movement about an axis through the pin 46. It will be appreciated that this assembly allows the top end of the interior handle 24 and connected interior portion of the bracket 40 to move freely about the pivot pin 46.

The interior clip 36 is secured to the exterior clip 38 with the top edge of the door 28 sandwiched between the clips 36, 38. During assembly, the bushing 39 on the exterior clip 38 is inserted in a circular opening 48 in the door 28. A threaded fastener 50 extends through a corresponding opening 51 in the interior clip 36 into the cylindrical bushing 39. The bushing has a threaded opening extending there through transverse to the longitudinal axis of the exterior clip 38 for receiving the fastener 50.

Figure 10:
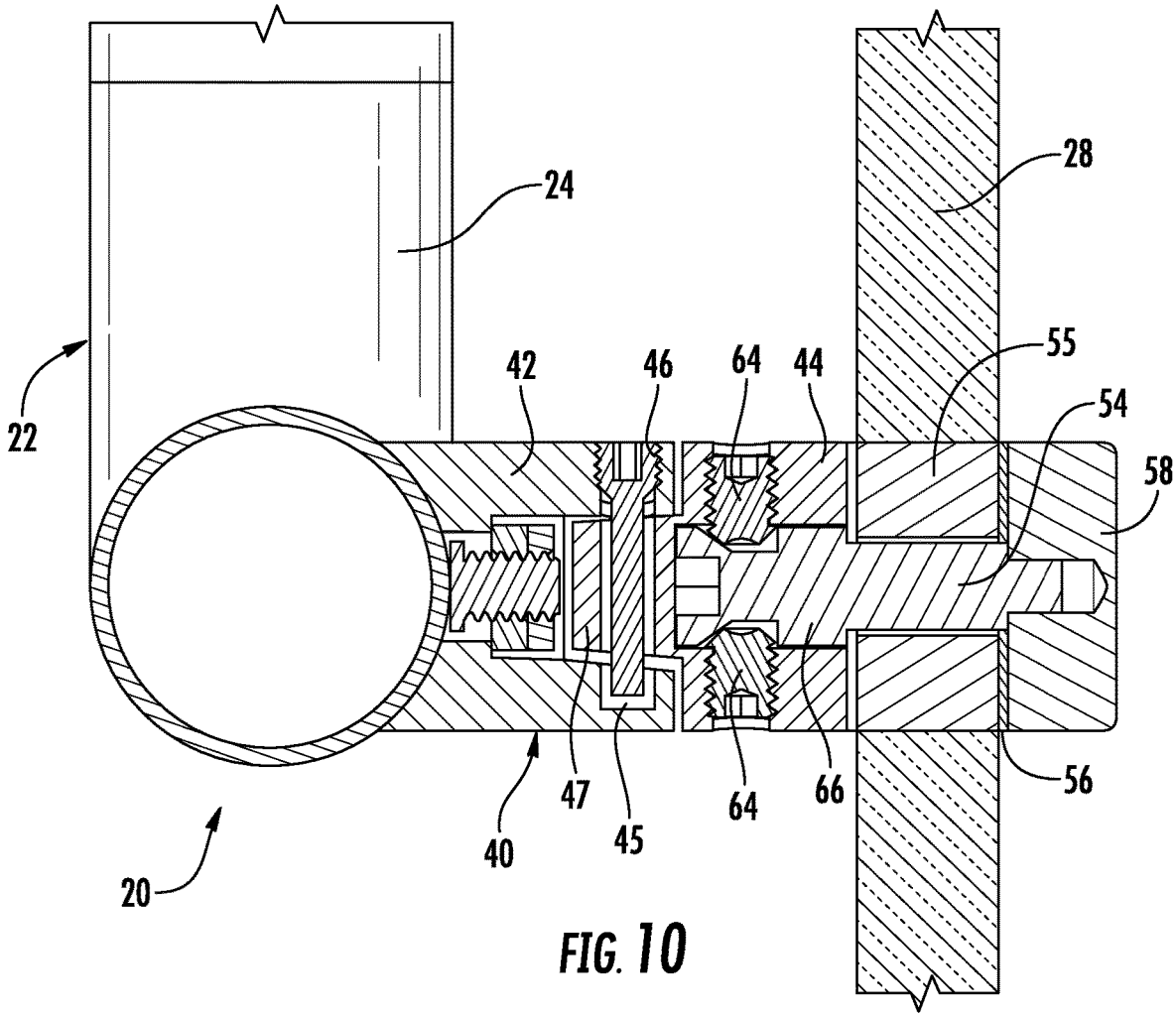
FIG. 10 is a longitudinal cross-section view showing an embodiment of a bottom bracket for use with the panic exit device and door handle as shown in FIG. 1.
Figure 11:
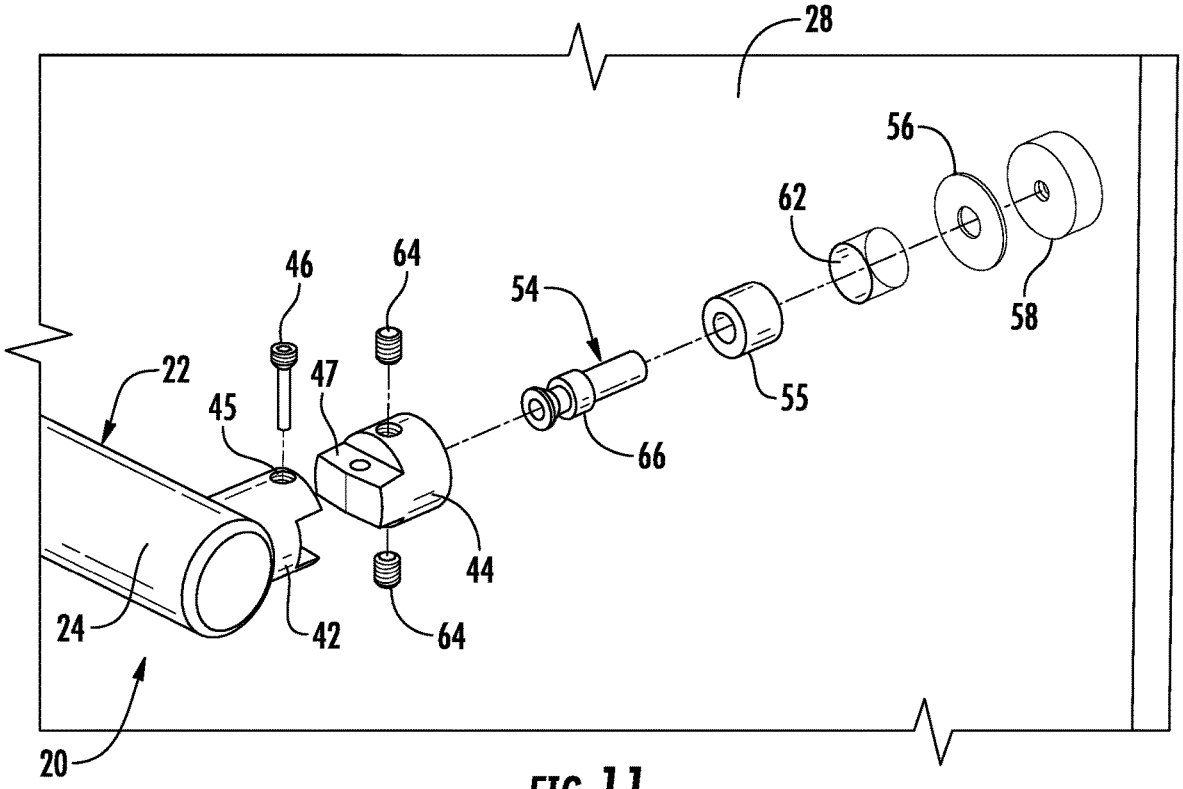
FIG. 11 is a partial interior exploded perspective view of the bottom bracket and the exit device and door handle as shown in FIG. 10.
Figure 12:
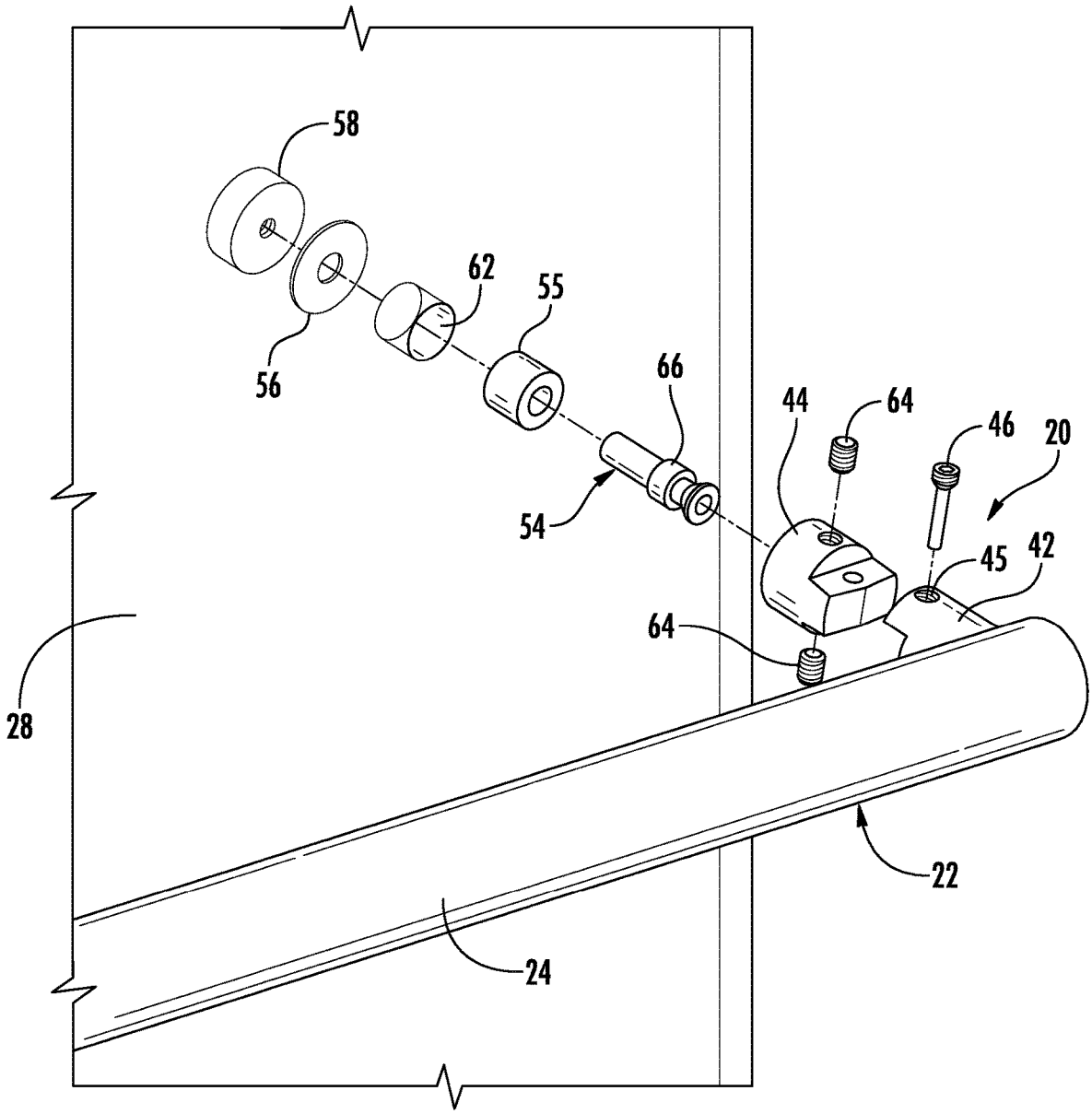
FIG. 12 is another partial interior exploded perspective view of the bottom bracket and the exit device and door handle as shown in FIG. 10.

Referring now to FIGS. 10-12, mounting hardware is shown for pivotally securing the end of the horizontal component of the interior door handle 24 to the door 28. In one embodiment, the mounting hardware comprises the two-piece arcing pivot bracket 40, a fastener 54, a bushing 55, and an exterior washer 56 and threaded end cap 58. For use with the horizontal component of the interior door handle 24, the interior portion 42 of the bracket 40 is rigidly secured to the outer end of the interior handle 24. The interior portion 42 and the exterior portion 44 of the bracket 40 are connected for relative pivotal movement about an axis through the pin 46 engaged through the bifurcated end of the interior portion 42 and the boss 47 on the exterior portion 44. It will be appreciated that this assembly allows the outer end of the horizontal component of the interior handle 24 to move freely about the pivot pin 46.

Figure 14:
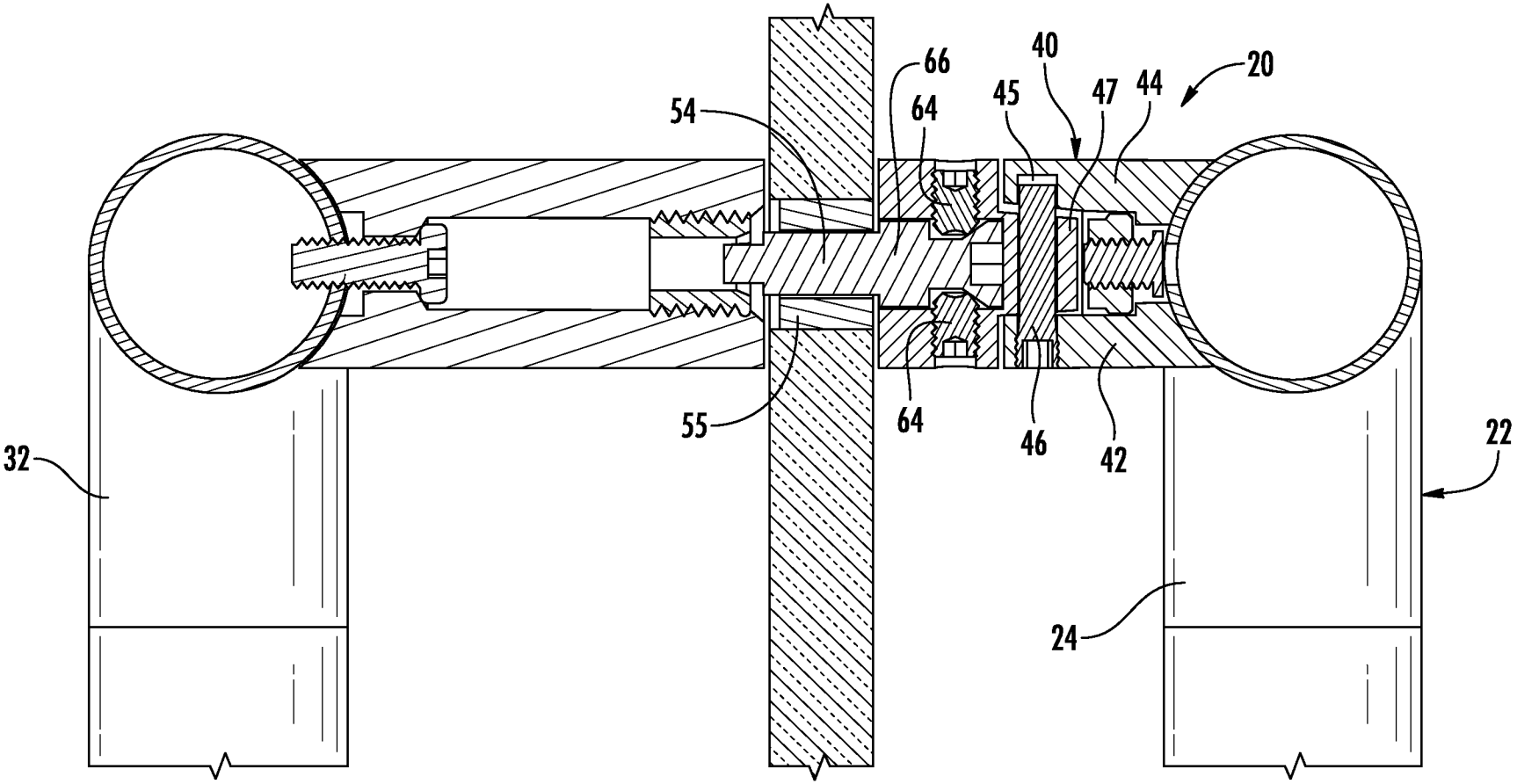
FIG. 14 is a longitudinal cross-section view showing the embodiment of a bottom bracket for use with the panic exit device and door handle as shown in FIG. 10 including an exterior handle.

As seen in FIGS. 10-12, the exterior portion 44 of the bracket 40 defines a transverse bore 60 through the body of the exterior portion 44 and a channel extending longitudinally through the exterior piece 44 and opening into the bore 60. The fastener 54 has an annular flange 66 intermediate along the length of the fastener 54. The fastener 54 is slidingly received in the channel in the exterior portion 44 such that a length of the fastener 54 up to the flange 66 is disposed in the exterior portion 44. To connect the exterior portion 44 of the bracket 40 to the fastener 54, a pair of set screws 64 are threaded into the transverse bore 60. The set screws 64 can be tightened into the space between the head of the fastener 54 and the flange 66 to restrict relative longitudinal movement of the fastener 54 in the exterior portion 44 of the bracket. The remainder of the fastener 54 including a threaded distal passes through the bushing 55 located in a door opening 62 and connects to the end cap 58 on the exterior surface of the door 28. Another embodiment of this arrangement is shown in FIG. 14 wherein the fastener 54 connects to an end of the exterior door handle 32. In both cases, the handle assembly 22 is pivotally secured at its ends to the door 28 to provide the requisite freedom of movement for the interior handle 24 to be moved toward and away from the door to unlatch or latch, respectively, the latch mechanism.

Figure 13A:
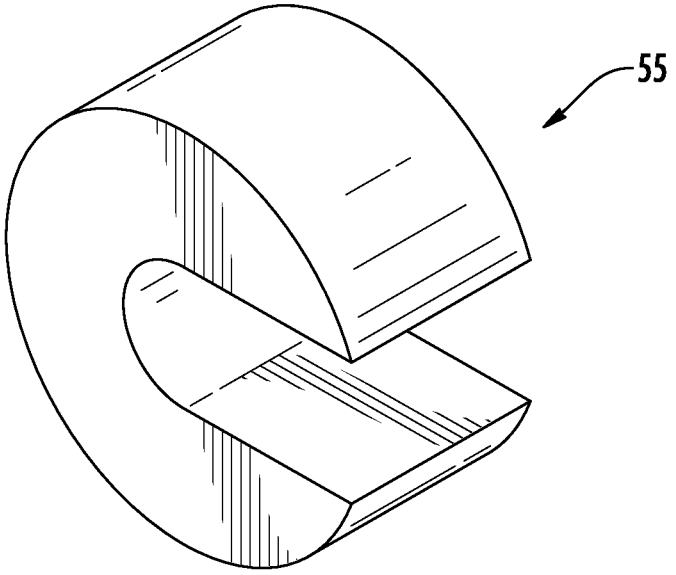
FIGS. 13A and 13B are a perspective view and an elevation view, respectively, of a C-shaped bushing for use with the bottom bracket as shown in FIG. 10.
Figure 13B:
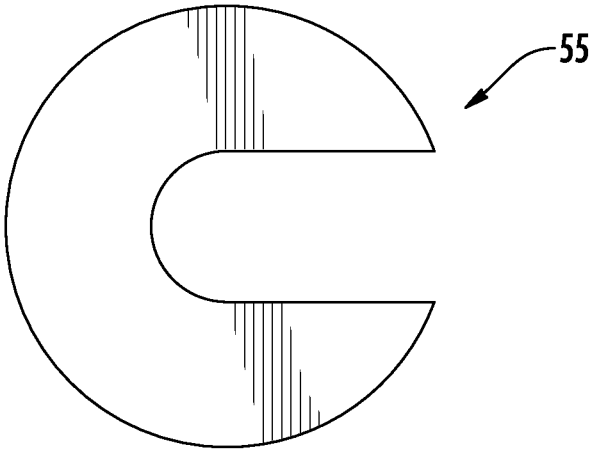

In one embodiment, the bushing 55 in the door 28 may be a C-shaped bushing as shown in FIGS. 13A and 13B. The C-shaped bushing 55 provides for ease of adjustment of the interior door handle 24 so that the handle is precisely located relative to the door 28.

Figure 15:
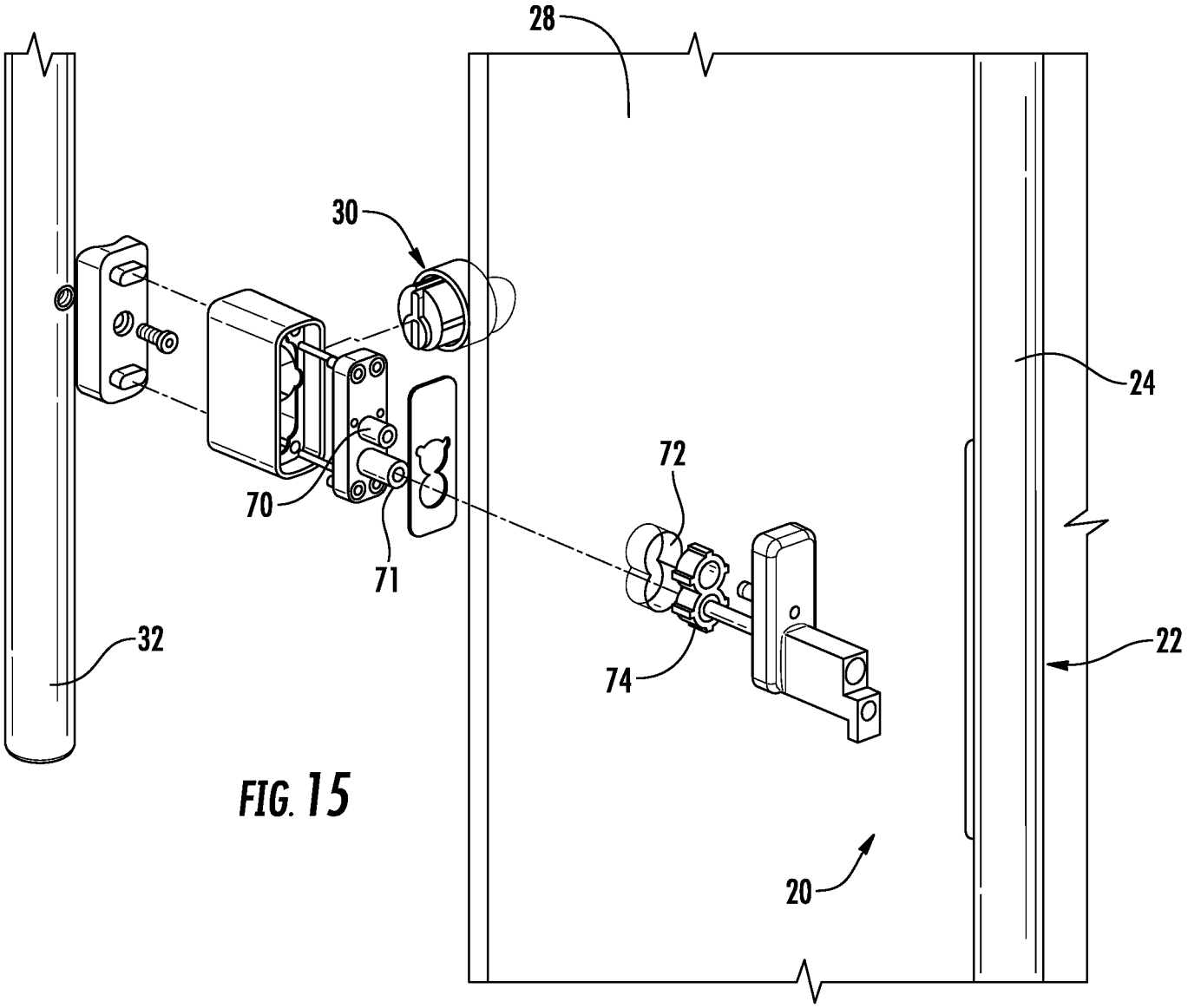
FIG. 15 is a partial interior exploded perspective view showing an embodiment of a lock mechanism for use with the panic exit device and door handle as shown in FIG. 1.
Figure 16:
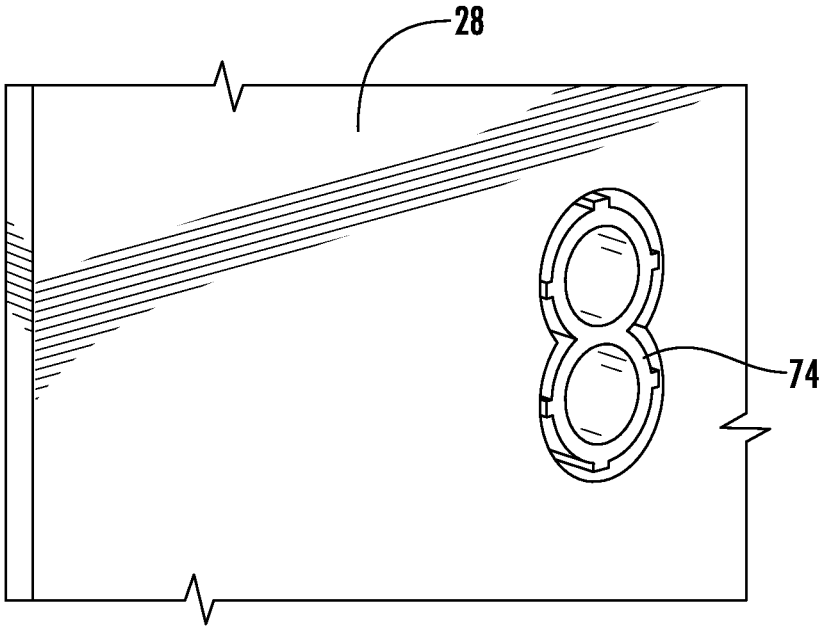
FIG. 16 is perspective view of a snowman-shaped bushing for use with the locking mechanism as shown in FIG. 15.
Figure 17:
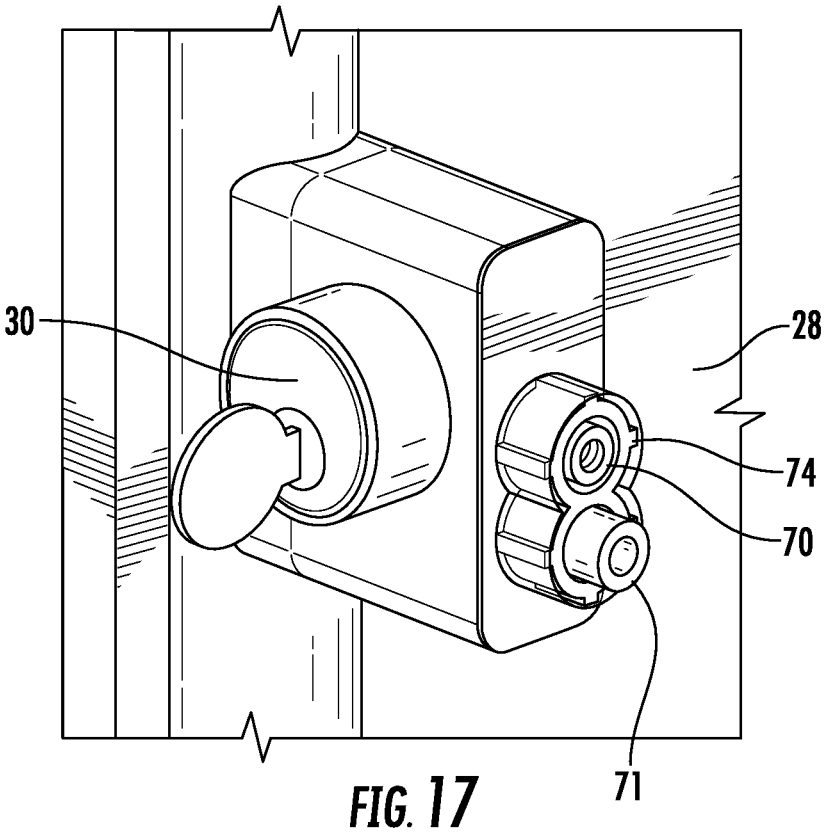
FIG. 17 is a perspective view of the snowman-shaped bushing as shown in FIG. 16 in the glass door and associated with the locking mechanism as shown in FIG. 15.

The locking mechanism 30 is shown in FIGS. 15-17. The locking mechanism 30 is useful to open the door 28 from the exterior side when the door is locked or latched, usually by turning a key operated lock cylinder. The locking mechanism 30 has two vertically spaced posts 70, 71 extending transversely from the lock cylinder housing and through the door 28. A hole 72 is provided in the door 28 to accommodate the posts 70, 71. As seen in FIGS. 15-17, the hole 72 is a figure-eight, or "snowman shape. A similarly shaped bushing 74 is provided in the hole 72 in the door 28 for passing the posts 70, 71. The bushing 74 allows the lock mechanism 30 to be precisely located for engagement with latch mechanism inside the interior door handle 24 for actuating or locking the latch mechanism.

The exit device 20 and handle assembly 22 as described herein have many advantages, including pivot pin connections via the arcing pivot brackets 40 at the ends of the interior handle 24 on the door 28. The use pins 46 for making the connections allow the interior handle 24 to be easily removed and reattached. This is useful during the installation when adjustment of the handle 24 to the holes through the glass door 28 can be a trial-and-error process. The arcing pivot brackets 40 also allow the interior handle 24 ends to pivot during operation in a conventional manner. The arcing pivot bracket 40 is a uniquely shaped bracket end which, in conjunction with the pin attachment, achieves the pivoting motion while allowing the ease of the pin attachment. Moreover, the C-shaped alignment bushing 55 at the end of the horizontal length of the interior handle 24 passes the fastener 54 holding the end brackets through the door 28. The "C-shape" of the bushing 55 allows the bushing to be adjusted in the door opening 62 to accommodate the position of the fastener 54 passing through the bushing 55. Further, the bushing 74 for the lock actuator posts 70, 71 has one less opening than the conventional three-tiered bushings. The new bushing 74 requires only two conjoined holes for receiving the "snowman-shaped" bushing.

Figure 18:
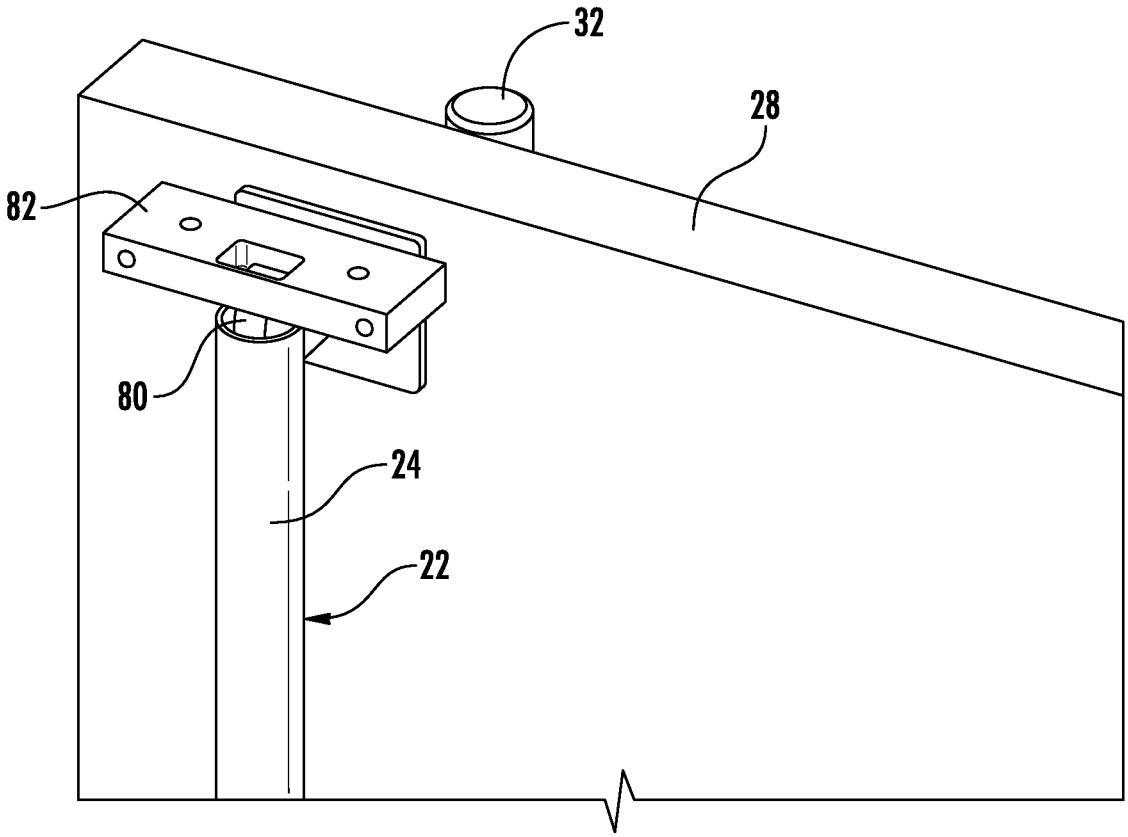
FIG. 18 is a perspective view showing an embodiment of a latch mechanism for use with the panic exit device and door handle as shown in FIG. 1.

An embodiment of a Pullman-type latch 80 and mechanical strike 82 is shown in FIGS. 18-23 for use in the latch mechanism of the panic exit device 20. The free edge of the door 28 partially shown in FIG. 18 is adapted to fit adjacent a surface of a door frame (not shown) from which the door 28 is supported when the door is in a closed position. The strike 82 is mounted to the door frame such that in a projected position, the latch bolt 84 fits in the strike to prevent movement of the door from the closed position.

Figure 19:
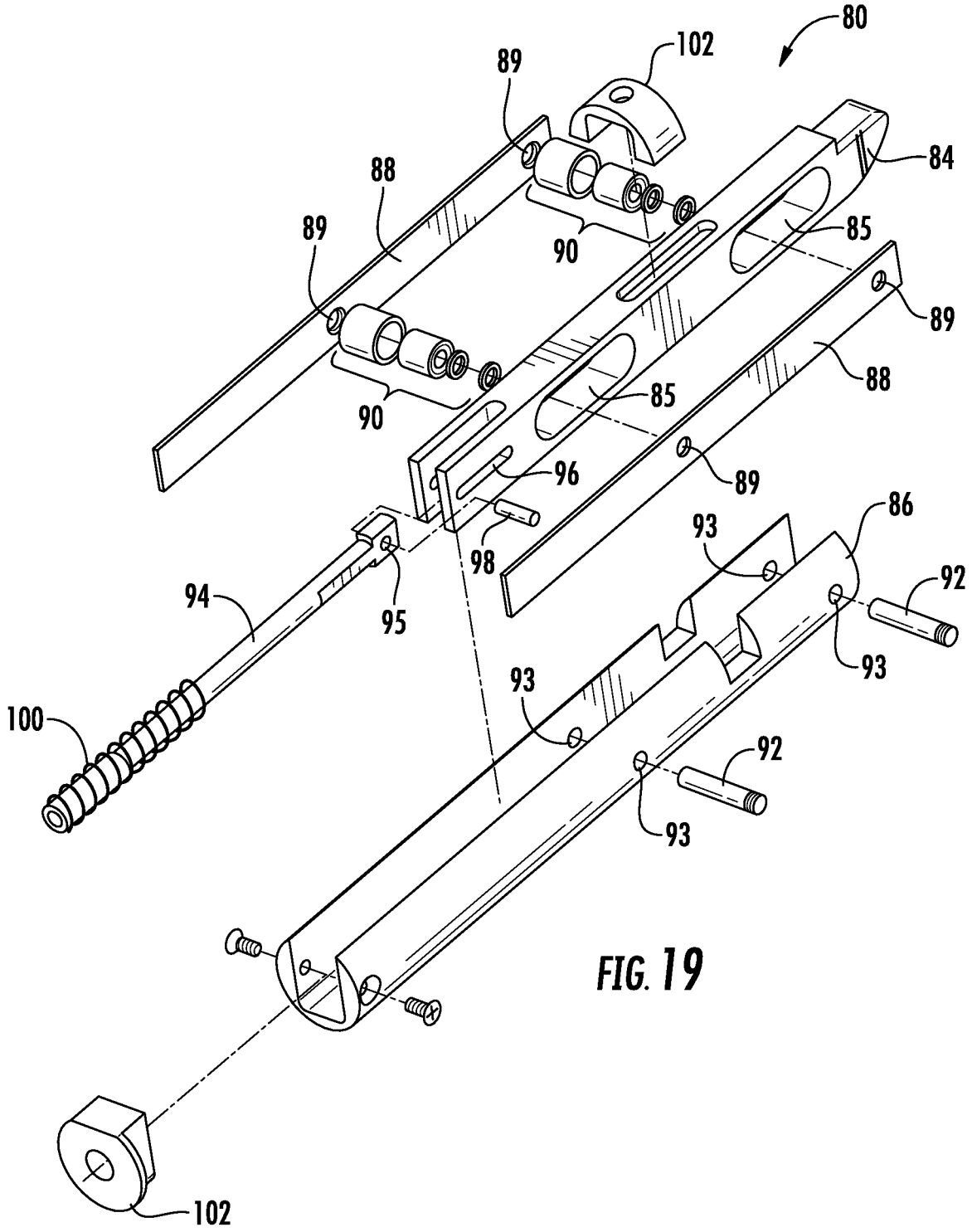
FIG. 19 is an exploded perspective view of a portion of a distal end of the latch mechanism as shown in FIG. 18.
Figure 20:
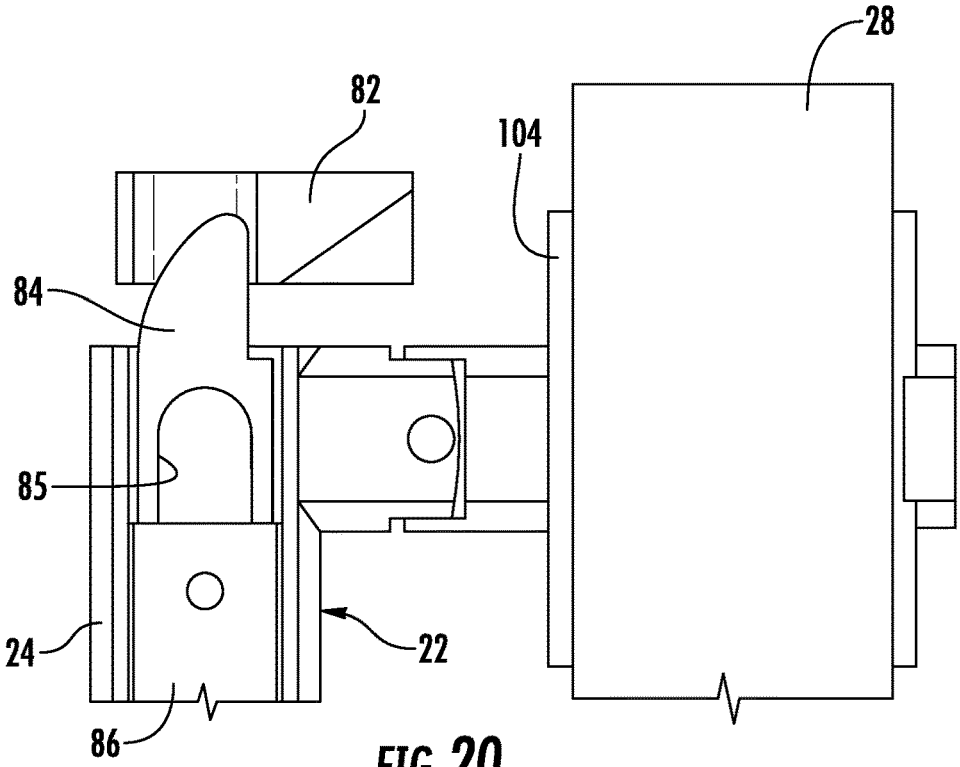
FIG. 20 is a transverse cross-section of the latch mechanism as shown in FIG. 18.
Figure 21:
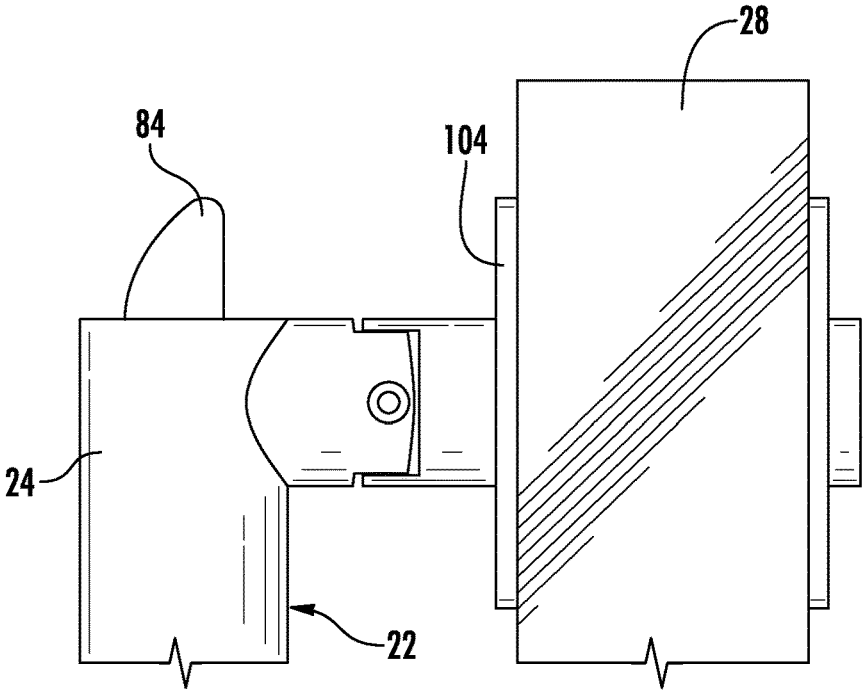
FIG. 21 is a side elevation view of a distal end of the latch mechanism as shown in FIG. 18 with the strike removed for clarity.
Figure 22:
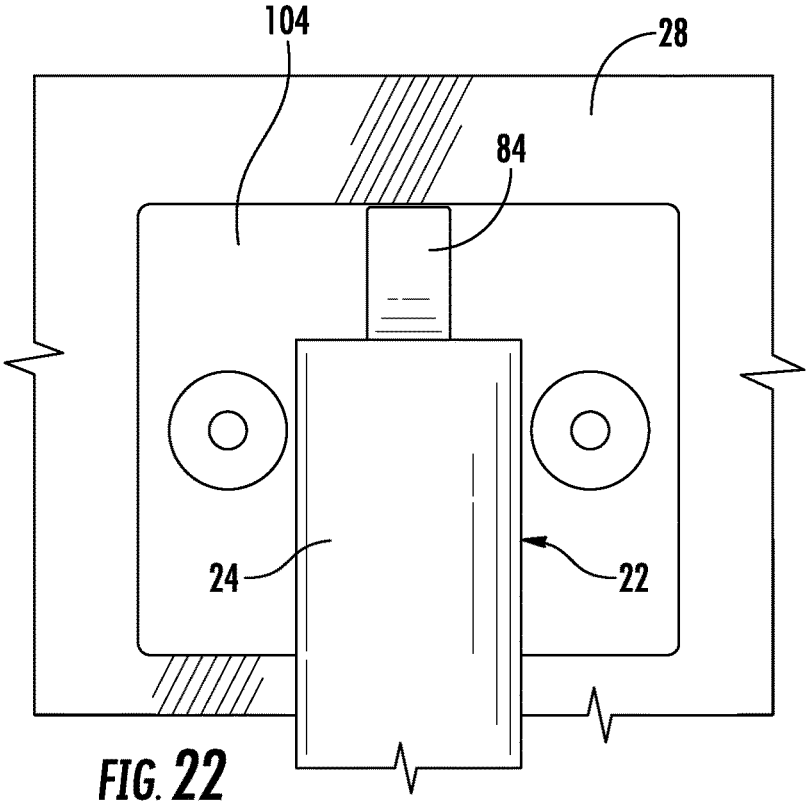
FIG. 22 is a front elevation view of a distal end of the latch mechanism as shown in FIG. 21.
Figure 23:
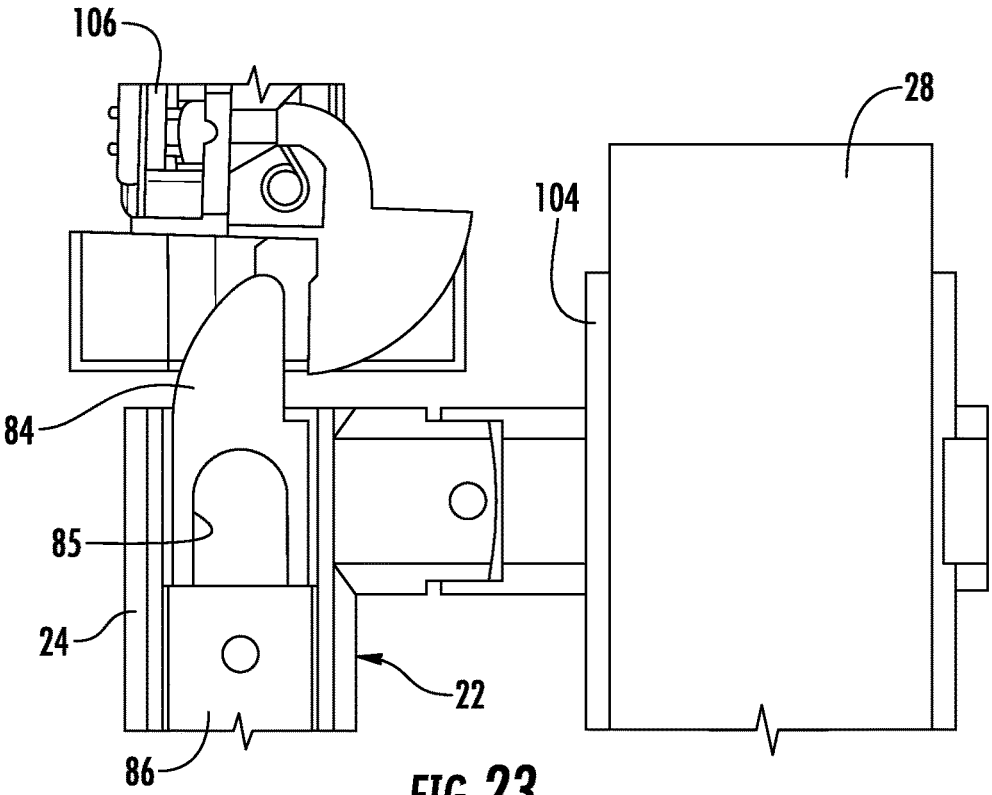
FIG. 23 is a transverse cross-section of the latch mechanism as shown in FIG. 18 including an electric strike.

Referring to FIG. 19, the latch 80 comprises an elongated latch bolt 84 slidingly received in a channel formed in a latch housing 86 for reciprocal axial movement from a projected position beyond the latch housing 84 and extending from the upper end of the interior handle 24 to a retracted position. The latch bolt 84 is supported in the latch housing 86 by a pair of elongated planar slide plates 88 disposed in the channel adjacent each side of the latch bolt 84. The latch bolt 84 defines a pair of spaced longitudinally extending slots 85. Each slot 85 is configured to receive a roller assembly 90 including a sleeve rotatably mounted on a roller bearing. The roller assemblies 90 are rotatably mounted in the slots 85 on pins 92 passing transversely through corresponding openings 89, 93 in the housing 86 and the slide plates 88. In this arrangement, the latch bolt 84 is longitudinally movable relative to the housing 86 along the length of the slots 85.

The latch mechanism of the exit device 20 is operably connected to a vertical pull rod 94 slidably disposed in the vertical component of the interior handle 24 as is conventional. The inner end of the latch bolt 84 has a longitudinal groove configured to receive the distal of the pull rod 94. The inner end of the latch bolt 84 defines a pair of longitudinal slots 96 opening into the groove. A pin 98 passes through the slots 96 and a hole 95 at the outer end of the pull rod 94 for connecting the pull rod 94 to the latch bolt 84. The pull rod 94 is thus longitudinally movable relative to the housing 86 along the length of the slots 96. A coil spring 100 is provided on the pull rod 94 for biasing the pull rod 94 and the latch bolt 84 upwardly to the extended position into the strike 82 once inward pressure on the interior door handle 24 is released. An end guide 102 and insert 103 are provided on the housing 86 for guiding and supporting relative reciprocal movement of the latch bolt 84 in the housing 86.

In use, when the door 28 to which the exit device 20 is mounted is closed, the latch bolt 84 is extended into the strike 82 in the latched position as shown in FIG. 18. Retraction of the latch bolt 84 from the interior of the door 28 is achieved by depressing the interior door handle 24 toward the door 28. This movement of the door handle 24 is translated into a generally longitudinal motion via the latch mechanism in a known manner to force the pull rod 94 downwardly pulling the latch bolt 84 longitudinally into the housing 86 to retract the latch bolt 84 from the strike 82. The door 28 is now unlatched and may be opened by continuing to push on the interior door handle 24. When the handle 24 is subsequently released from the manual pressure, the handle 24 returns to its original position relative to the door 28 shown in FIG. 1 due to the force of return springs. The latch bolt 84 is returned to the projected position under force of the spring 100 which is compressed during retraction of the latch bolt 84.

It is understood that the slots 85 in the latch bolt 84 permit movement of the latch bolt 84 toward the retracted position without movement of the pull rod 94. In this instance, the latch bolt 84 is moved to the retracted position in response to engagement with the strike 82 during a closing of the door 28. Once the latch bolt 84 clears the front of the strike 82, the spring 100 forces the latch bolt 84 to the extended position in the strike for holding the door 28 in a closed and latched position.

Figure 24:
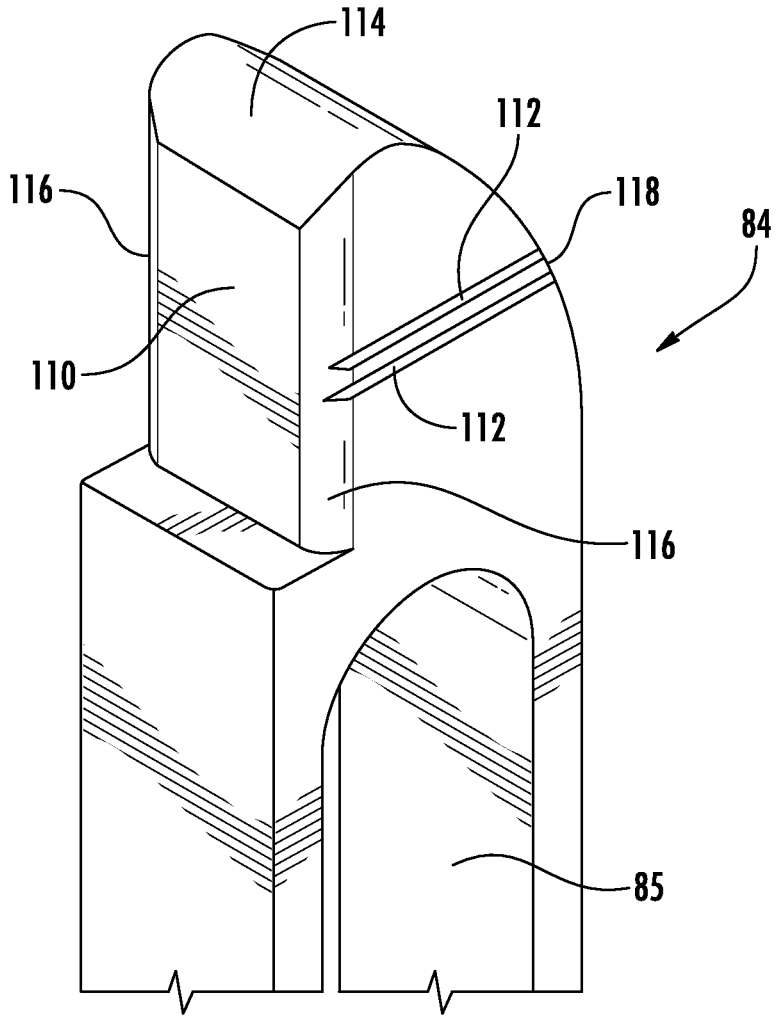
FIG. 24 is a close-up perspective view of a distal end of an embodiment of a latch bolt for use in the latch mechanism shown in FIG. 19.

As shown in FIG. 24, a distal end of the latch bolt 84 comprises a planar outer face 110 of the latch bolt 84 for maximizing the engaged surface area between the surface of the latch bolt 84 and the strike 82. The side surfaces of the latch bolt 84 have scribed lines 112 for facilitating proper installation by providing a visual representation of the proper engagement point for the lower end of the strike 82 on the latch bolt 84. The upper scribed line is arranged such that a preferred minimum surface area of the latch bolt 84 in the strike 82 is about 0.09 square inches. The distal tip 114 of the latch bolt 84 is rounded allowing the latch bolt 84 to release from the strike 82 during retraction with reduced outward opening force. Similarly, the planar outer face 110 of the latch bolt 84 terminates in bevelled edges 116 for reducing wear between the latch bolt 84 and the strike 82 due to arcing motion. The latch bolt 84 further comprises a radiused inner face 118 for reducing the force necessary to close the door 28. The curved inner face 118 may have a radius of between about 0.5 inches and about 2 inches. In one embodiment, shown in FIG. 23, the latch bolt 84 is received in an electric strike 106 wherein an outer surface of the latch bolt 84 having a one inch radius is the same as the radiused surface of the keeper contacted by the latch bolt 84 during closing.

Although the panic exit device and door handle have been shown and described in considerable detail with respect to only a few exemplary embodiments thereof, it should be understood by those skilled in the art that we do not intend to limit the description to the embodiments since various modifications, omissions and additions may be made to the disclosed embodiments without materially departing from the novel teachings and advantages of the device, particularly in light of the foregoing teachings. Accordingly, we intend to cover all such modifications, omission, additions and equivalents as may be included within the spirit and scope of the description as defined by the following claims. In the claims, means-plus-function clause(s) are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An exit device for use with a door, the exit device comprising:

a door handle adapted to be mounted to an interior of the door for pivoting movement toward and away from the door from a first position to a second position, the door handle when mounted to the door includes a horizontal component extending horizontally and a vertical component extending vertically; and a pair of brackets, one bracket adapted to be operatively connected adjacent a horizontal end of the horizontal components between the horizontal component and the door and another bracket adapted to be operatively connected adjacent a vertical end of the vertical component between the vertical component and the door, each of the pair of brackets comprising:

a first bracket member secured to the door handle, a second bracket member adapted to be secured to the door, and a pin for joining the first bracket member and the second bracket member for rotation about an axis through the pin, wherein the first bracket member and the second bracket member pivot relative to one another around the pin when the door handle moves between the first position and the second position.

2. The exit device as recited in claim 1, wherein the axis of rotation of the first bracket member relative to the second bracket member around the pin is parallel to surface of the door to which the second bracket member is secured.

3. The exit device as recited in claim 1, wherein the axis of rotation of the first bracket member relative to the second bracket member around the pin is perpendicular to a longitudinal axis of the door to which the second bracket member is secured.

4. The exit device as recited in claim 1, further comprising a latch bolt disposed at one end of the door handle adjacent an edge of the door and movable relative to the door handle between a projected position extending outwardly of the door handle for latching the door in a closed position and a retracted position where the latch bolt is inside the door handle for allowing the door to be opened.

5. The exit device as recited in claim 4, further comprising a retractor element disposed in the door handle for substantially rectilinear movement relative to the door handle from a first position to a second position in a path along a longitudinal axis of the door handle, the retractor element operatively connected between the door handle and the latch bolt, the retractor element moving toward the second position of the retractor element and the latch bolt moving toward the retracted position in response to movement of the door handle toward the second position of the door handle.

6. The exit device as recited in claim 5, further comprising a spring associated with the retractor element for biasing the latch bolt to the projected position, wherein movement of the door handle toward the second position of the door handle moves the latch bolt from the projected position to the retracted position of the latch bolt for loading the spring.

7. The exit device as recited in claim 4, wherein a distal end of the latch bolt has a planar outer surface for engaging a strike when the door is in the closed position.

8. The exit device as recited in claim 7, wherein the planar outer surface of the latch bolt terminates in beveled edges.

9. The exit device as recited in claim 4, wherein a distal tip of the latch bolt is rounded.

10. The exit device as recited in claim 4, wherein a distal end of the latch bolt has a curved inner surface for engaging a strike during closing of the door.

11. The exit device as recited in claim 10, wherein the curved inner surface of the latch bolt has a radius of curvature of from about 0.5 inches to about 2.0 inches.

12. The exit device as recited in claim 1, wherein a length of the vertical component of the door handle is defined by a vertical distance from the horizontal component of the door handle to a top edge of the door.

13. The exit device as recited in claim 1, wherein a length of the horizontal component of the door handle is defined by a horizontal distance from the vertical component of the door handle to adjacent a hinged edge of the door.

14. The exit device as recited in claim 1, further comprising a fastener passing through an opening in the door for securing to the door the second bracket member associated with an end of the horizontal component of the door handle, and a c-shaped bushing adapted to be disposed in the opening in the door for positioning the fastener.

15. The exit device as recited in claim 1, further comprising a lock mechanism adapted to be mounted to an outer surface of the door, the lock mechanism including two elongated projections passing through an opening in the door for operative connection to a latch mechanism in the door handle, and a bushing comprising a pair of conjoined circular members adapted to be disposed in the opening in the door, each circular member defining an opening for receiving a projection.

16. The exit device as recited in claim 15, wherein the pair of conjoined circular members are vertically aligned in the door.

17. The exit device as recited in claim 1, wherein the first bracket member and the second bracket member comprise arcing surfaces to allow for pivoting motion of the first bracket member and the second bracket member with respect to each other.

18. The exit device as recited in claim 17, wherein one of the first bracket member or the second bracket member comprise a bifurcated end with legs each having an arcing surface, and wherein another of the first bracket member or the second bracket member comprise a boss having an arcing surface.

19. An exit device for use with a door, the exit device comprising:

a door handle adapted to be mounted to an interior of the door for pivoting movement toward and away from the door from a first position to a second position, the door handle when mounted to the door includes a horizontal component extending horizontally and a vertical component extending vertically; and a first pivot bracket adapted to be operatively connected adjacent to an end of either the horizontal component or the vertical component between the door handle and the door, the first pivot bracket comprising:

a first bracket member secured to the door handle, a second bracket member adapted to be secured to the door, and a pin for joining the first bracket member and the second bracket member for rotation about an axis through the pin, wherein the first bracket member and the second bracket member comprise arcing surfaces to allow for pivoting motion of the first bracket member and the second bracket member with respect to each other; and a second bracket adapted to be operatively connected adjacent to the end of either the horizontal component or the vertical component opposite the first pivot bracket;

wherein the first bracket member and the second bracket member pivot relative to one another around the pin when the door handle moves between the first position and the second position.

20. An exit device for use with a door, the exit device comprising:

a door handle adapted to be mounted to an interior of the door for pivoting movement toward and away from the door from a first position to a second position, the door handle when mounted to the door includes a horizontal component extending horizontally and a vertical component extending vertically; and a first bracket adapted to be operatively connected adjacent to an end of the horizontal component and a second bracket adapted to be operatively connected adjacent to an end of the vertical component between the door handle and the door, wherein the first bracket and the second bracket allow the pivoting movement of the door handle when the door handle moves between the first position and the second position;

a lock mechanism adapted to be mounted to an outer surface of the door, the lock mechanism including two elongated projections passing through an opening in the door for operative connection to a latch mechanism in the door handle, and a bushing comprising a pair of conjoined circular members adapted to be disposed in the opening in the door, each circular member defining an opening for receiving a projection;

wherein the conjoined circular members are vertically aligned in the door.

21. The exit device of claim 19, wherein the second bracket comprises a second pivot bracket and wherein the second pivot bracket comprises:

the first bracket member secured to the door handle, the second bracket member adapted to be secured to the door, and the pin for joining the first bracket member and the second bracket member for rotation about the axis through the pin.

* * * * *